US011547156B2

(12) United States Patent
Xie

(10) Patent No.: US 11,547,156 B2
(45) Date of Patent: Jan. 10, 2023

(54) COMBINATION AIR FILTER AND PROTECTIVE GOWN

(71) Applicant: Qinbo Xie, Guangdong (CN)

(72) Inventor: Qinbo Xie, Guangdong (CN)

(73) Assignee: Shenzhen Aurora Technology Limited, Shenzhen (CN)

( * ) Notice: Subject to any disclaimer, the term of this patent is extended or adjusted under 35 U.S.C. 154(b) by 362 days.

(21) Appl. No.: 16/894,926

(22) Filed: Jun. 8, 2020

(65) Prior Publication Data

US 2020/0297044 A1 Sep. 24, 2020

(30) Foreign Application Priority Data

Mar. 19, 2020 (CN) ..... 202020353282.4

(51) Int. Cl.

| | |
|---|---|
| ***A41D 1/00*** | (2018.01) |
| ***A41D 13/002*** | (2006.01) |
| ***A62B 17/00*** | (2006.01) |
| ***A41D 13/12*** | (2006.01) |
| ***F04D 25/08*** | (2006.01) |

(Continued)

(52) U.S. Cl.

CPC ..... *A41D 1/002* (2013.01); *A41D 13/0025* (2013.01); *A41D 13/1209* (2013.01); *A62B 17/005* (2013.01); *A62B 17/006* (2013.01); *F04D 25/08* (2013.01); *A62B 7/10* (2013.01); *A62B 18/006* (2013.01); *F21V 33/0096* (2013.01)

(58) Field of Classification Search

CPC ..... A41D 13/0025; A41D 13/1209; A62B 18/006; A62B 17/005; A62B 17/006; A62B 7/00; A62B 7/10; F04D 25/08

See application file for complete search history.

(56) References Cited

U.S. PATENT DOCUMENTS 2,657,396 A * 11/1953 Klein ..... A41D 13/0025 165/46
3,064,448 A * 11/1962 Whittington ..... F24F 1/04 62/51.1
3,292,179 A * 12/1966 Iacono, Jr. ..... A62B 17/005 2/457

(Continued)

FOREIGN PATENT DOCUMENTS

| | | | | |
|---|---|---|---|---|
| CN | 2730167 | * | 10/2005 | ..... A41D 13/00 |
| GB | 2248173 A | * | 4/1992 | ..... A41D 13/0025 |
| WO | WO-2011010811 A2 | * | 1/2011 | ..... A41D 13/0025 |

OTHER PUBLICATIONS

English translation of Hu (CN 2730167), accessed via espacenet.com (last visited Aug. 31, 2022). (Year: 2022).*

*Primary Examiner* — Alissa L Hoey
*Assistant Examiner* — Patrick J. Lynch

(57) ABSTRACT

A combined air filter and protective gown includes a protective gown; at least one tube; at least one air filter; a waist belt; check valves disposed at a face, two hands, and two ankles of the protective gown respectively; and ties for fastening the face, the hands, and the ankles of the protective gown respectively. One end of each tube is terminated inside the protective gown and the other end thereof is attached to the air filter. Each air filter is attached to the waist belt. Each air filter includes a centrifugal fan, a circuit board, a UV lamp, a filter element formed of activated carbon, a power supply, a housing for enclosing the centrifugal fan, the circuit board, the UV lamp, the filter element, and the power supply, and a cover threadedly secured to the housing.

7 Claims, 3 Drawing Sheets

(51) Int. Cl.

| | |
|---|---|
| ***F21V 33/00*** | (2006.01) |
| ***A62B 7/10*** | (2006.01) |
| ***A62B 18/00*** | (2006.01) |

(56) References Cited

U.S. PATENT DOCUMENTS

| | | | | |
|---|---|---|---|---|
| 2005/0011517 | A1* | 1/2005 | Steinert | A62B 17/006 128/202.19 |
| 2007/0283961 | A1* | 12/2007 | Hsieh | A62B 17/006 128/205.27 |
| 2013/0269090 | A1* | 10/2013 | Liu | A41D 13/0025 2/456 |
| 2015/0282543 | A1* | 10/2015 | Rippert | A62B 17/005 2/456 |
| 2018/0220721 | A1* | 8/2018 | Houde | A41D 13/0053 |

* cited by examiner

COMBINATION AIR FILTER AND PROTECTIVE GOWN

BACKGROUND OF THE INVENTION

1. Field of the Invention

The invention relates to medical equipment and more particularly to a combination air filter and protective gown having improved characteristics.

2. Description of Related Art

Personal protective equipment (PPE) clothing includes PPE for firefighters, PPE for industry, medical gowns, PPE for military, and PPE for specific groups. PPE clothing is designed to provide maximum protection to the user and thus is characterized by anti-moisture, excellent permeability, being strong, and being resistant to high pressure. PPE clothing has applications including the industry, the electronic industry, healthcare industry, anti-chemical warfare and immunity.

Conventionally, PPE gowns are airtight. But air exists inside the PPE gown. Temperature inside the PPE gown increases greatly when the wearer works. Further, microorganisms may quickly grow inside the protective gown and excessive heat may be accumulated therein. Thus, the wearer may feel a degree of discomfort. Furthermore, airborne diseases can be transmitted through vents of the protective gown. This is especially undesirable to medical employees.

Thus, the need for improvement still exists.

SUMMARY OF THE INVENTION

The invention has been made in an effort to solve the problems of the conventional art including increased internal temperature, microorganisms growth, excessive heat, discomfort, and airborne diseases transmission by providing a combination air filter and protective gown having novel and nonobvious characteristics.

To achieve above and other objects of the invention, the invention provides a combination air filter and protective gown comprising a protective gown; at least one tube; at least one air filter; a waist belt; a plurality of check valves disposed at a face, two hands, and two ankles of the protective gown respectively; and a plurality of ties for fastening the face, the hands, and the ankles of the protective gown respectively; wherein a first end of each tube is terminated inside the protective gown and a second end thereof is attached to the air filter; wherein each air filter is attached to the waist belt; wherein each air filter includes a centrifugal fan, a circuit board, a ultraviolet (UV) lamp, a filter element formed of activated carbon, a power supply, a housing for enclosing the centrifugal fan, the circuit board, the UV lamp, the filter element, and the power supply, and a cover threadedly secured to the housing; and wherein the centrifugal fan is threadedly secured to the housing, the circuit board is threadedly secured to the centrifugal fan and are electrically interconnected, the UV lamp is disposed at an outlet of the centrifugal fan and is electrically connected to the circuit board, the filter element is disposed at an inlet of the centrifugal fan, and the power supply is disposed adjacent to a first side of the housing and is configured to supply electricity to the centrifugal fan, the circuit board, and the UV lamp.

Preferably, further comprises a zipper disposed on the protective gown, and wherein the ties are implemented as straps.

Preferably, the waist belt is attached to the waist of the protective gown by hook and loop fasteners.

Preferably, further comprises a push-button and a power-on light both disposed on the housing, both the push-button and the power-on light being electrically connected to the circuit board.

Preferably, further comprises a power socket disposed on the housing so that mains power is configured to supply to the power supply for charging by electrically connecting to the power socket.

Preferably, further comprises an opening disposed through the circuit board and aligned with the inlet of the centrifugal fan.

Preferably, further comprises a plurality of louvers disposed on the cover, and a battery cover disposed adjacent to the louvers and aligned with the power supply.

The invention has the following advantageous effects in comparison with the prior art: air cleaned by the air filter can flow to inside of the protective gown through the tube to inflate the protective gown. And in turn, the clean air expels moisture and excessive heat out of the protective gown through gaps between the check valves and the ties while preventing foul air from entering the protective gown through the check valves. As a result, a wearer may feel a degree of freshness and comfort. A wearer may increase or decrease the number of air filters attached to the waist belt and change locations of the air filters. The filter element is used to remove pollutants from air as well as inactivate bacteria, viruses, and protozoa. As a result, clean air is produced by the air filter.

The above and other objects, features and advantages of the invention will become apparent from the following detailed description taken with the accompanying drawings.

DETAILED DESCRIPTION OF THE INVENTION

Figure 1:
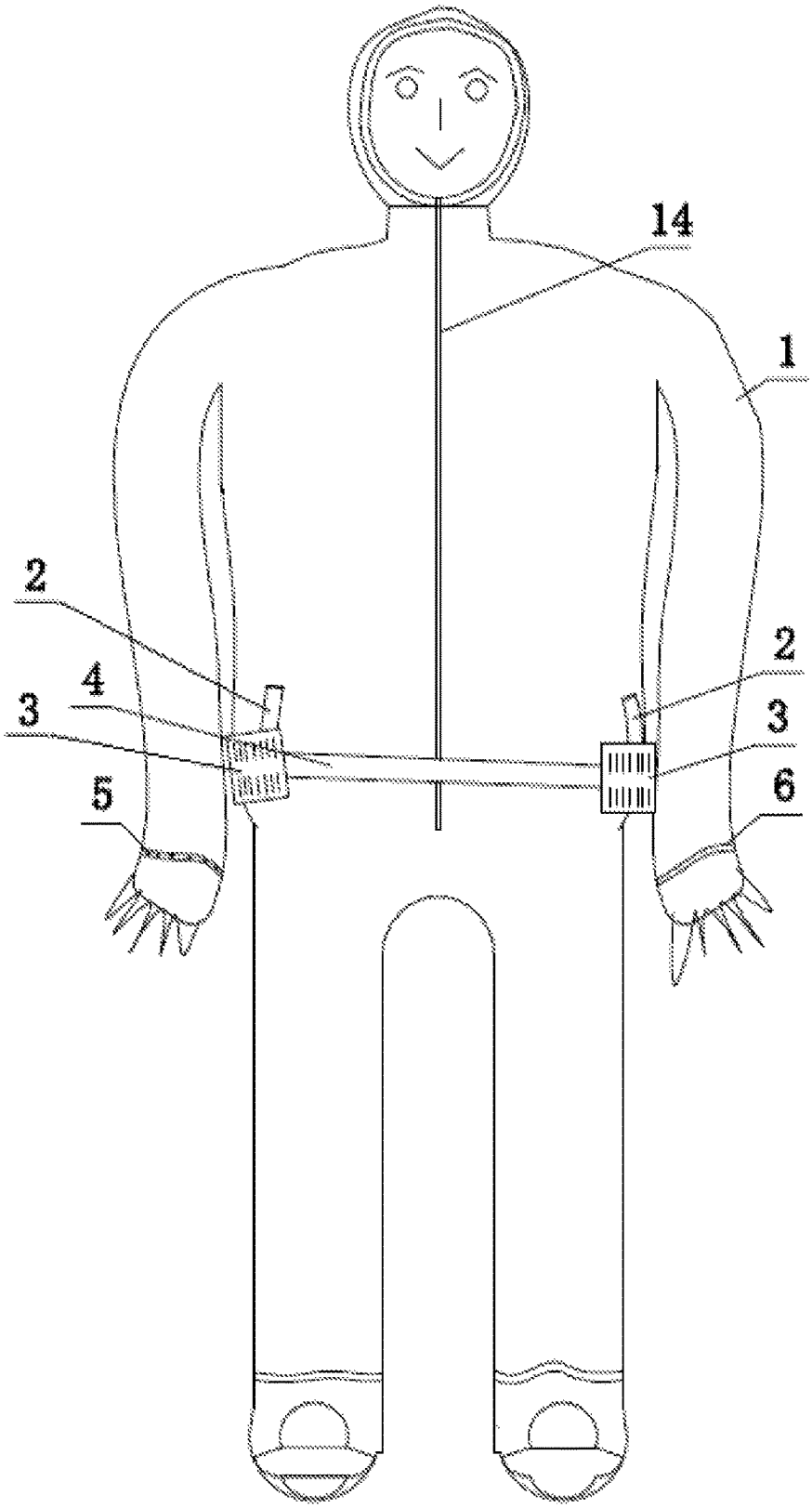
FIG. 1 is a perspective view of a combination air filter and protective gown according to the invention.
Figure 2:
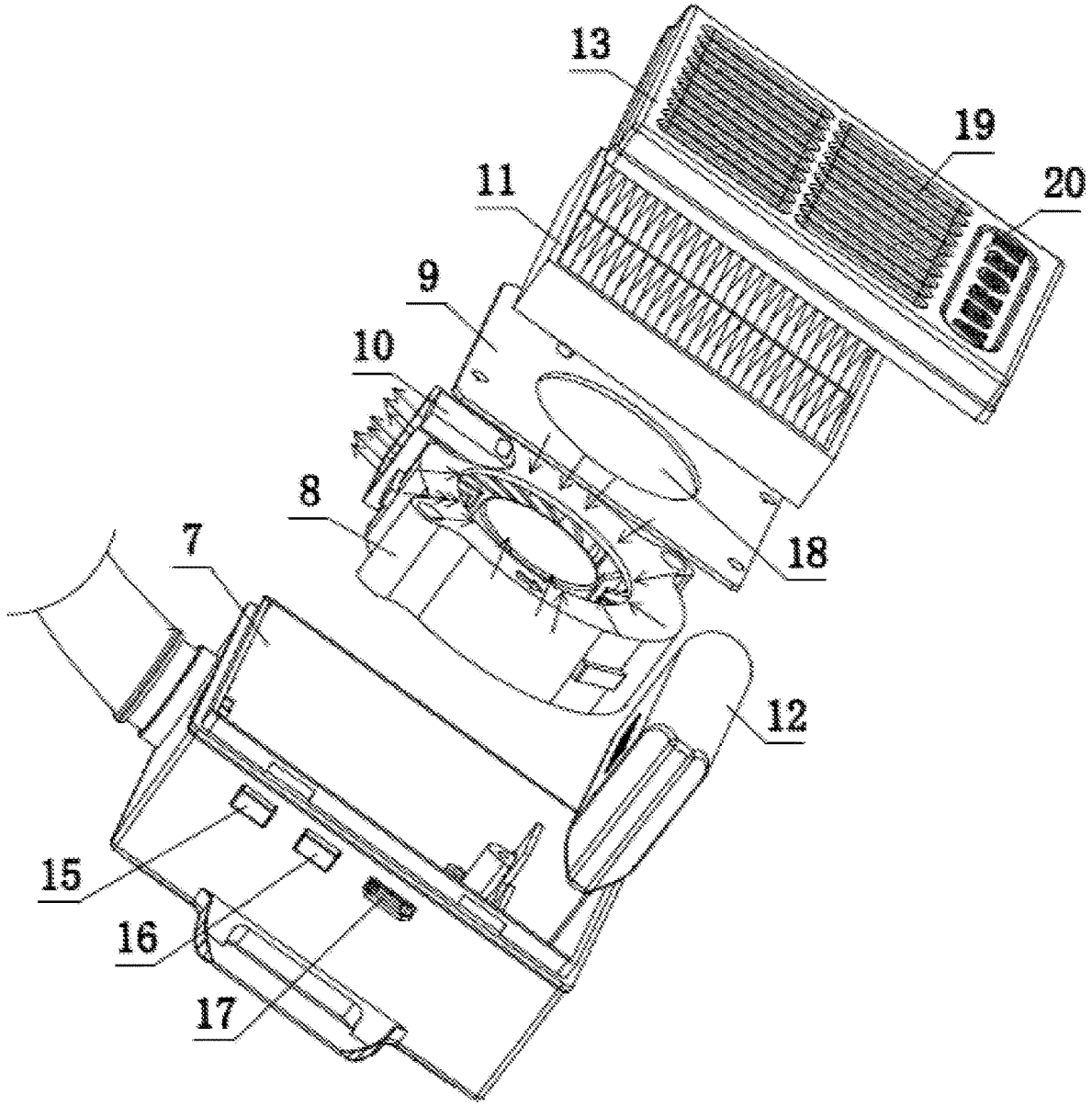
FIG. 2 is an exploded view of the air filter.
Figure 3:
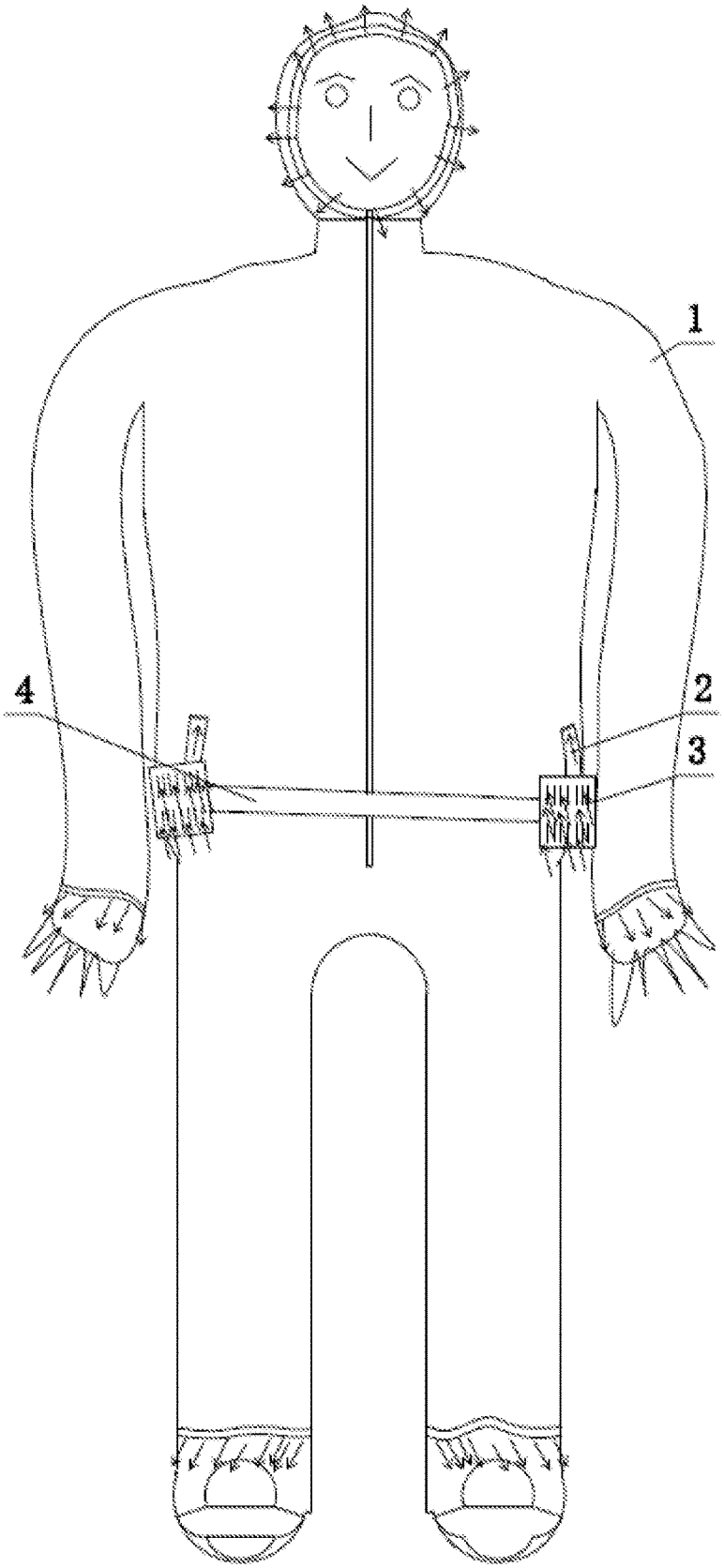
FIG. 3 is a view similar to FIG. 1 showing airflow through the protective gown.

Referring to FIGS. 1 to 3, a combination air filter and protective gown in accordance with the invention comprises a protective gown 1, twos tubes 2, two air filters 3, a waist belt 4, a plurality of check valves 5 provided at a face, two hands, and two ankles of the protective gown 1 respectively, and a plurality of ties 6 for fastening the face, the hands, and the ankles of the protective gown 1 respectively as discussed in detail below.

A first end of the tube 2 is terminated inside the protective gown 1 and a second end thereof is attached to the air filter 3. The air filters 3 are attached to the waist belt 4 so that air cleaned by the air filter 3 can flow to inside of the protective gown 1 through the tube 2 to inflate the protective gown 1. And in turn, the clean air expels moisture and excessive heat out of the protective gown 1 through gaps between the check valves 5 and the ties 6 while preventing foul air from entering the protective gown 1 through the check valves 5. As a result, a wearer may feel a degree of freshness and comfort.

The air filter 3 includes a centrifugal fan 8, a circuit board 9 for control purposes, a ultraviolet (UV) lamp 10, a filter element 11 formed of active carbon, a power supply (e.g., rechargeable battery) 12, a housing 7 for enclosing the above components, and a cover 13 threadedly secured to the housing 7. The centrifugal fan 8 is threadedly secured to the housing 7. The circuit board 9 is threadedly secured to the centrifugal fan 8 and they are electrically interconnected. The UV lamp 10 is disposed at an outlet of the centrifugal fan 8 and is electrically connected to the circuit board 9. The filter element 11 is disposed at an inlet of the centrifugal fan 8. The power supply 12 is disposed adjacent to one side of the housing 7 and is used to supply electricity to the centrifugal fan 8, the circuit board 9 and the UV lamp 10. A medical employee may increase or decrease the number of air filters 3 attached to the waist belt 4 and change locations of the air filters 3. The filter element 11 is used to remove pollutants from air as well as inactivate bacteria, viruses, and protozoa. As a result, clean air is produced by the air filter 3.

Further, a zipper 14 is provided on the protective gown 1 for binding the edges of an opening of the protective gown 1, the ties 6 are implemented as straps, and the waist belt 4 is attached to the waist of the protective gown 1 by hook and loop fasteners.

Furthermore, a push-button 15 and a power-on light 16 are provided on the outer surface of the housing 7 and they are electrically connected to the circuit board 9. A pressing of the push-button 15 may activate the air filter 3. The power-on light 16 may light when the power supply 12 is activated.

In addition, a power socket 17 is provided on the outer surface of the housing 7 adjacent to the power-on light 16. Mains power may be supplied to the power supply 12 for charging by inserting an end of a power cord into the power socket 17. The power supply 12 is used to supply electricity to all components of the air filter 3. A circular opening 17 is provided through the circuit board 9 and aligned with the inlet of the centrifugal fan 8 so that fresh air produced by the centrifugal fan 8 may pass through the opening 17. A pressing of the push-button 15 may cause the circuit board 9 to activate the centrifugal fan 8. Louvers 19 are provided on the cover 13 for bringing fresh air to the inlet of the centrifugal fan 8, and a battery cover 20 is provided adjacent to the louvers 19 and aligned with the power supply 12. The battery cover 20 can be opened prior to removing the power supply 12 from the air filter 3.

An operation of the invention is discussed in detail below. A medical employee may wear the protective gown 1, put the waist belt 4 on his or her waist, and secure the waist belt 4 to the protective gown. The employee may press the push-button 15 to activate the circuit board 9 which in turn activates the centrifugal fan 8 to draw air through the filter element 11 which removes solid particulates such as dust, pollen, mold, and bacteria from the air. The activated carbon of the filter element 11 is used to remove pollutants from air as well as inactivate bacteria, viruses, and protozoa. As a result, clean air is produced by the air filter 3. The clean air flows to inside of the protective gown 1 through the tubes 2. And in turn, the clean air expels moisture and excessive heat out of the protective gown 1 through gaps between the check valves 5 and the ties 6 while preventing foul air from entering the protective gown 1 through the check valves 5. As a result, a wearer may feel a degree of freshness and comfort.

While the invention has been described in terms of preferred embodiments, those skilled in the art will recognize that the invention can be practiced with modifications within the spirit and scope of the appended claims.

What is claimed is:

1. A combination air filter and protective gown, comprising:

a protective gown;

at least one tube;

at least one air filter;

a waist belt;

a plurality of check valves disposed at a face of the protective gown, a plurality of check valves disposed at two hands of the protective gown respectively, and a plurality of check valves disposed at two ankles of the protective gown respectively; and a plurality of ties for fastening the face of the protective gown, a plurality of ties for fastening the hands of the protective gown respectively, and a plurality of ties for fastening the ankles of the protective gown respectively;

wherein a first end of each tube is terminated inside the protective gown and a second end thereof is attached to the air filter;

wherein each air filter is attached to the waist belt;

wherein each air filter includes a centrifugal fan, a circuit board, a ultraviolet (UV) lamp, a filter element formed of activated carbon, a power supply, a housing for enclosing the centrifugal fan, the circuit board, the UV lamp, the filter element, and the power supply, and a cover threadedly secured to the housing; and wherein the centrifugal fan is threadedly secured to the housing, the circuit board is threadedly secured to the centrifugal fan and electrically interconnected with the centrifugal fan, the UV lamp is disposed at an outlet of the centrifugal fan and is electrically connected to the circuit board, the filter element is disposed at an inlet of the centrifugal fan, and the power supply is disposed adjacent to a first side of the housing and is configured to supply electricity to the centrifugal fan, the circuit board, and the UV lamp.

2. The combination air filter and protective gown of claim 1, further comprising a zipper disposed on the protective gown, and wherein the ties are implemented as straps.

3. The combination air filter and protective gown of claim 1, wherein the waist belt is attached to the waist of the protective gown by hook and loop fasteners.

4. The combination air filter and protective gown of claim 1, further comprising a push-button and a power-on light both disposed on the housing, both the push-button and the power-on light being electrically connected to the circuit board.

5. The combination air filter and protective gown of claim 1, further comprising a power socket disposed on the housing so that mains power is configured to supply to the power supply for charging by electrically connecting to the power socket.

6. The combination air filter and protective gown of claim 1, further comprising an opening disposed through the circuit board and aligned with the inlet of the centrifugal fan.

7. The combination air filter and protective gown of claim 1, further comprising a plurality of louvers disposed on the cover, and a battery cover disposed adjacent to the louvers and aligned with the power supply.

* * * * *